US009174762B2

(12) United States Patent
Skarin

(10) Patent No.: US 9,174,762 B2
(45) Date of Patent: Nov. 3, 2015

(54) POP-UP STRUCTURE USED FOR PRESENTING INFORMATION

(75) Inventor: Jakob Skarin, Nacka (SE)

(73) Assignee: JAKEBOX AB, Stockholm (SE)

( * ) Notice: Subject to any disclaimer, the term of this patent is extended or adjusted under 35 U.S.C. 154(b) by 0 days.

(21) Appl. No.: 14/009,147

(22) PCT Filed: Apr. 3, 2012

(86) PCT No.: PCT/SE2012/000049
§ 371 (c)(1),
(2), (4) Date: Oct. 1, 2013

(87) PCT Pub. No.: WO2012/138276
PCT Pub. Date: Oct. 11, 2012

(65) Prior Publication Data

US 2014/0319021 A1 Oct. 30, 2014

(30) Foreign Application Priority Data

Apr. 6, 2011 (SE) ..... 1100257-3

(51) Int. Cl.
*B65D 5/42* (2006.01)
*G09F 1/06* (2006.01)
(Continued)

(52) U.S. Cl.
CPC ..... *B65D 5/4266* (2013.01); *B42D 15/008* (2013.01); *B42D 15/042* (2013.01); *B42D 15/045* (2013.01); *G09F 1/06* (2013.01)

(58) Field of Classification Search
CPC .. B65D 5/4266; B65D 5/5213; B65D 5/5226; B65D 23/14; A45C 11/182; G09F 1/06; G09F 1/10; B42D 15/008; B42D 15/042; B42D 15/045
USPC ..... 206/232, 425, 754–757, 759, 760, 767, 206/768; 40/124.06, 124.08, 124.14
See application file for complete search history.

(56) References Cited

U.S. PATENT DOCUMENTS 5,626,232 A * 5/1997 Volkert et al. ..... 206/768
5,657,875 A * 8/1997 Hirsh et al. ..... 206/767
(Continued)

FOREIGN PATENT DOCUMENTS

GB 2286991 A * 9/1995
GB 2 326 842 A 1/1999
(Continued)

OTHER PUBLICATIONS

International Search Report for PCT/SE2012/00049, mailed May 11, 2012; ISA/SE.

*Primary Examiner* — Bryon Gehman
(74) *Attorney, Agent, or Firm* — Brooks Kushman P.C.

(57) ABSTRACT

The present invention relates to a popup-structure intended to accommodate a card, preferably a gift card (K) of bank card format, and comprising a first cover (1) and a second cover (3) which are joined together by a first fold line (A). Distinguishing features of the popup-structure according to the present invention are that it comprises a second panel element (11) which has an extent between a second fold line (B) and a third fold line (C), that the second fold line (B) is connected to the first cover (1), that the third fold line (C) is movable freely relative to the second cover (3), that the second fold line (B) and the third fold line (C) are parallel with one another, that a third panel element (30) extends between the third fold line (C) and a fifth fold line (E) which is connected to the second cover (3), that the third panel element (30) connects via a fourth fold line (D) to a tongue (20) which forms part of the popup-structure, that the tongue (20) is intended to support the card (K), that the fourth fold line (D) extends between an inner end of the third fold line (C) and an inner end of the fifth fold line (E), and that the fifth fold line (E) has a length (L2) which is greater than the length (L1) of the third fold line (C).

14 Claims, 8 Drawing Sheets

(51) Int. Cl.
*B42D 15/04* (2006.01)
*B42D 15/00* (2006.01)

(56) References Cited

U.S. PATENT DOCUMENTS

| | | | | |
|---|---|---|---|---|
| 5,799,424 | A | 9/1998 | Volkert et al. | |
| 6,311,142 | B1 | 10/2001 | Glassner | |
| 6,966,135 | B1 * | 11/2005 | McDonald | 40/124.08 |
| 6,971,524 | B1 * | 12/2005 | Voswinkel | 206/762 |
| 7,556,148 | B2 * | 7/2009 | Skarin | 206/754 |
| 7,938,270 | B2 * | 5/2011 | Davis | 206/768 |
| 8,474,619 | B1 * | 7/2013 | Chrisman | 40/124.08 |
| 8,499,478 | B1 * | 8/2013 | Glass et al. | 40/124.14 |
| 2005/0258060 | A1 * | 11/2005 | Katz | 206/425 |
| 2006/0144728 | A1 | 7/2006 | Skarin | |
| 2010/0043262 | A1 * | 2/2010 | O'Brien et al. | 40/124.06 |
| 2012/0266504 | A1 * | 10/2012 | Michlin | 40/124.08 |
| 2013/0139420 | A1 * | 6/2013 | Rubar | 40/124.08 |

FOREIGN PATENT DOCUMENTS

| | | | |
|---|---|---|---|
| JP | 3633385 | B2 | 3/2005 |
| WO | WO-2004/052752 | A1 | 6/2004 |

* cited by examiner

A
1

B
11
K
A
3
E
C

11
K
B
1
A
3
C
30
E
D

11
B
1
A
3
C
30
E
D

3
K
11
B
C
D
30
E

POP-UP STRUCTURE USED FOR PRESENTING INFORMATION

CROSS-REFERENCE TO RELATED APPLICATIONS

The application is a 371 U.S. National Stage of International Application No. PCT/SE2012/000049, filed Apr. 3, 2012, and claims priority to Swedish Patent Application No. 1100257-3, filed Apr. 6, 2011, the disclosures of which are herein incorporated by reference in their entirety.

TECHNICAL FIELD OF THE INVENTION

The present invention relates to a popup-structure comprising a first cover and a second cover which are joined together via a first fold line. A card is preferably accommodated in the popup-structure.

STATE OF THE ART

In a type of pack known from WO 2004/052752 for discs, particularly for compact discs (CDs), enveloping folds hold the disc firmly in the pack's closed and half-open states, and the space which accommodates the disc rises forwards to expose the disc when the pack is put into an open state.

OBJECTS AND FEATURES OF THE INVENTION

A primary object of the present invention is to propose a popup-structure of the kind defined in the introduction in which a tongue forming part of the structure moves between two positions during closing and opening of the popup-structure.

Another object of the present invention is that the tongue should assume a substantially concealed position when the popup-structure is closed and an exposed position when the popup-structure is open.

A further object of the present invention is to impart to the tongue a quarter-turn rotation when the popup-structure changes from a closed to an open state or vice versa.

At least the primary object of the present invention is achieved by the features indicated in the independent claim. Preferred embodiments of the invention are defined in the dependent claims.

BRIEF DESCRIPTION OF THE DRAWINGS

Preferred embodiments of the invention are described below with reference to the attached drawings, in which.

DETAILED DESCRIPTION OF PREFERRED EMBODIMENTS OF THE INVENTION

Figures 1A, 1B, 1C, 1D, 1E:
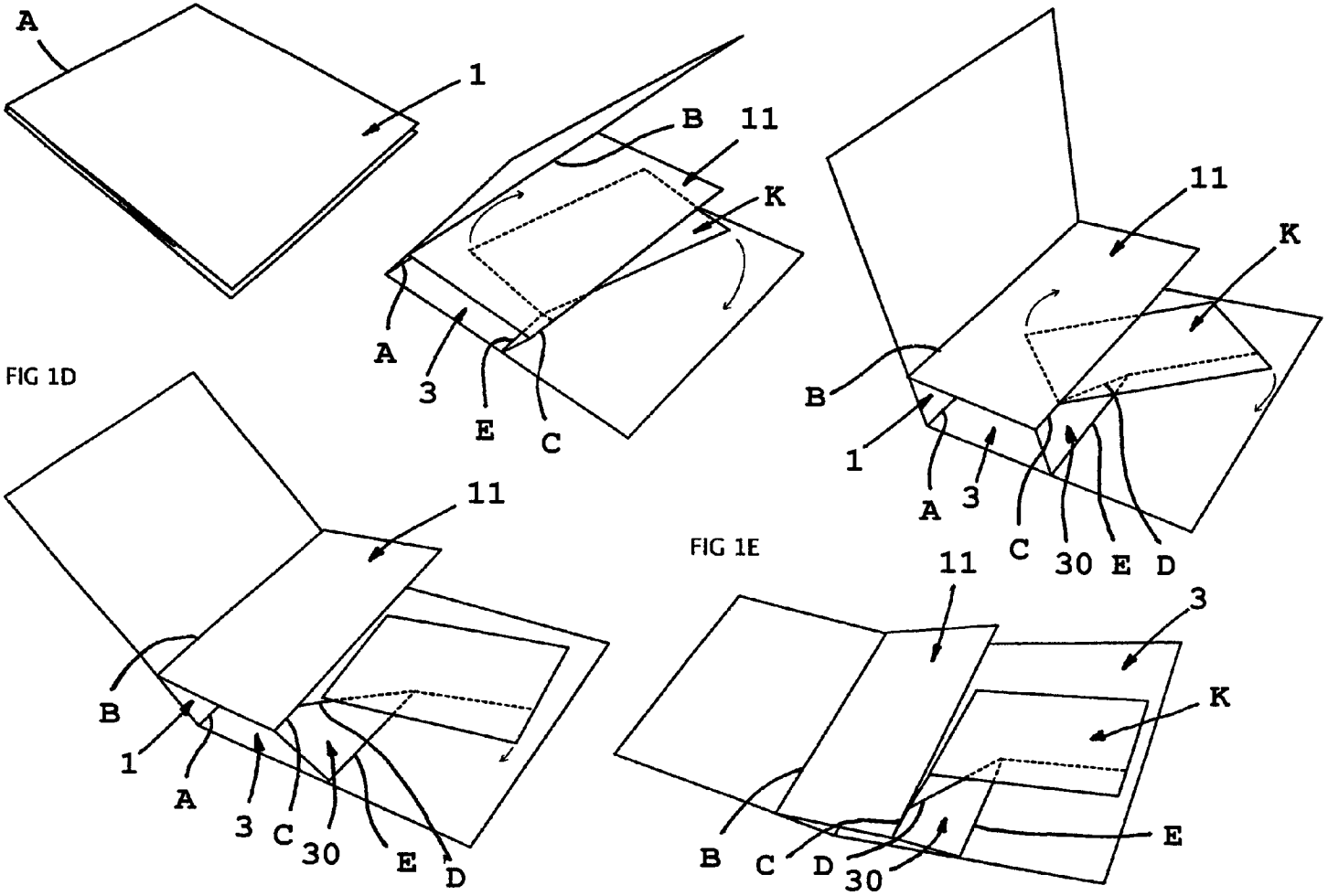
FIGS. 1A-1E are perspective views of different states of the popup-structure according to the present invention, in which a card of bank card format is accommodated in the popup-structure.

FIGS. 1A-1E show how a popup-structure according to the present invention changes from a closed state in FIG. 1A to an open state in FIG. 1E. In the embodiment depicted, the structure supports a card K of bank card format which is normally made of plastic material. The popup-structure according to the present invention is particularly intended to accommodate a gift card K which is of bank card format.

Examination of these diagrams will show that the gift card K turns about 90°, i.e. a quarter-turn, between closed and open states of the popup-structure.

FIGS. 1A-1E also show that the embodiment depicted of the popup-structure according to the present invention comprises two generally rectangular first and second covers 1 and 3 which are connected via a first fold line A. The two covers are preferably made of cardboard and are preferably integral with the first fold line A between them. The structure according to the present invention comprises also a popup-mechanism, preferably made of cardboard and provided with fold lines such that certain parts of the mechanism are connected to the two covers 1 and 3.

Figure 2:
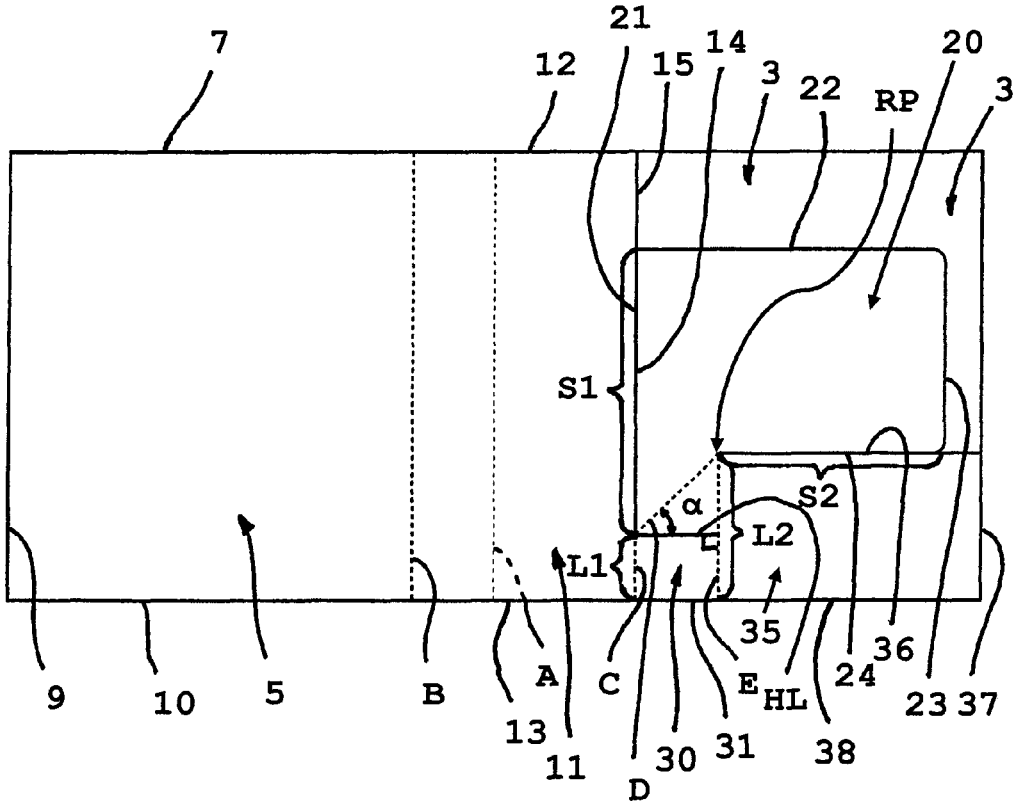
FIG. 2 is a plan view of the popup-structure according to the present invention when the structure is open, i.e. when covers which form part of it are in a common plane.
Figure 3:
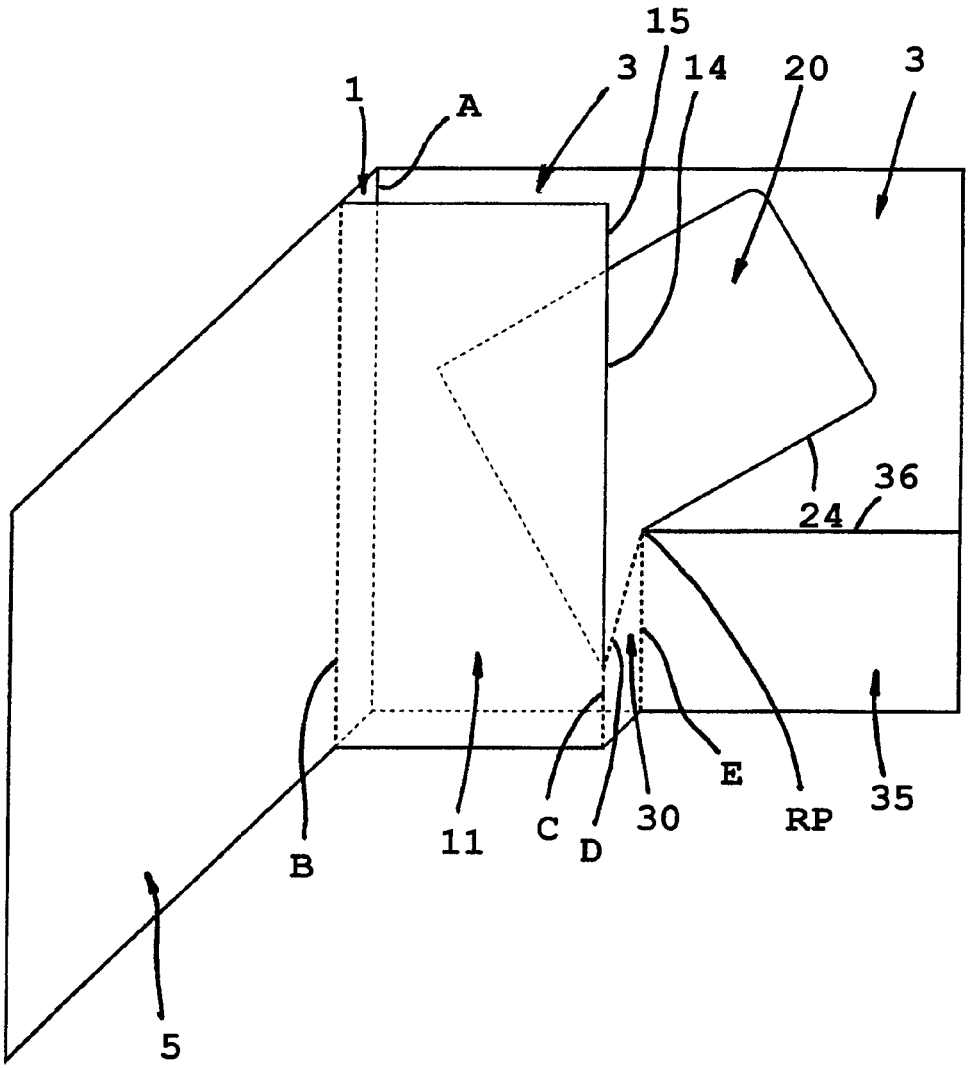
FIG. 3 is a light perspective view of the popup-structure according to the present invention when one cover has begun turning towards the other cover.
Figure 4:
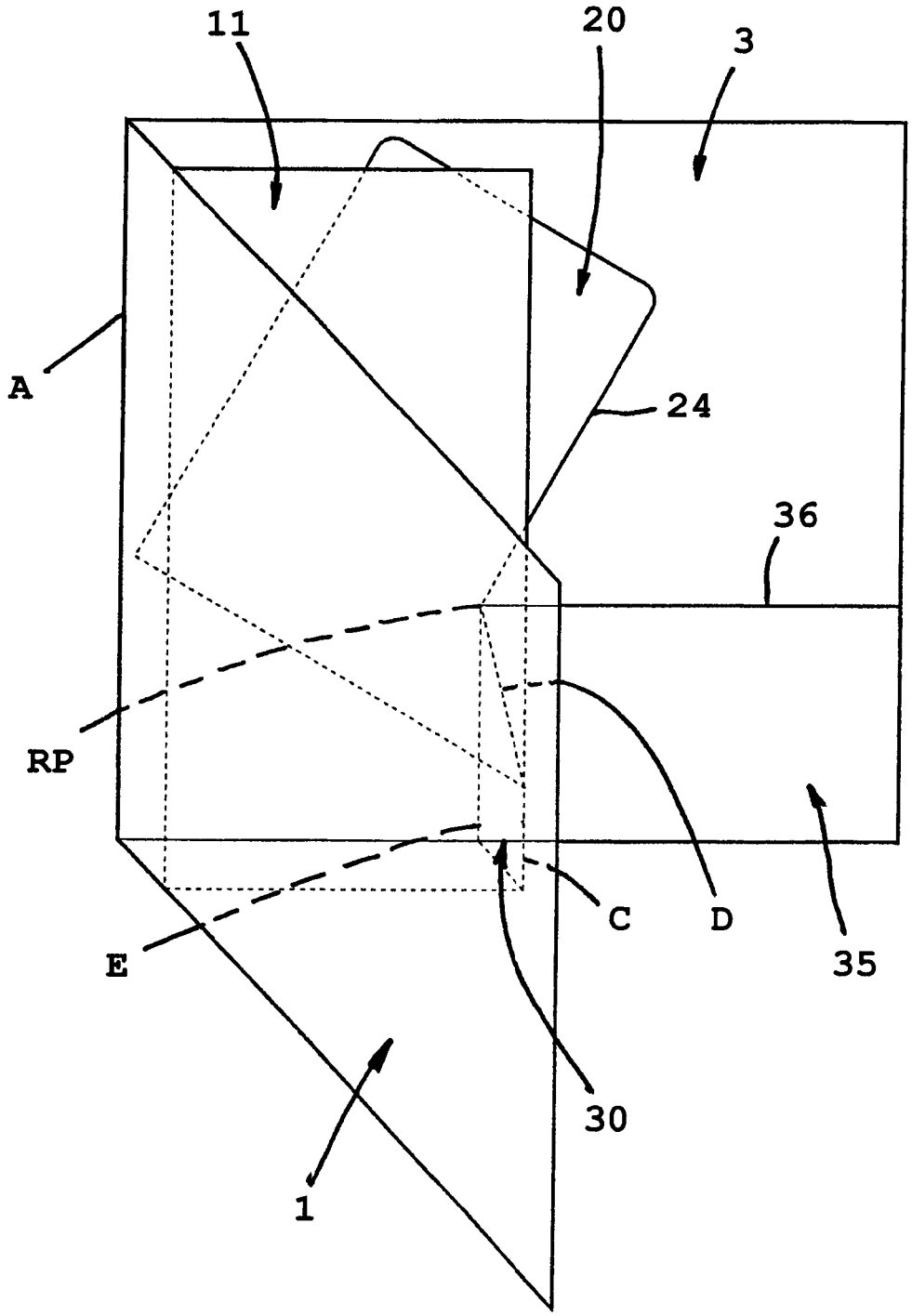
FIG. 4 is a light perspective view of the popup-structure according to the present invention in which the one cover has turned further towards the other cover.
Figure 5:
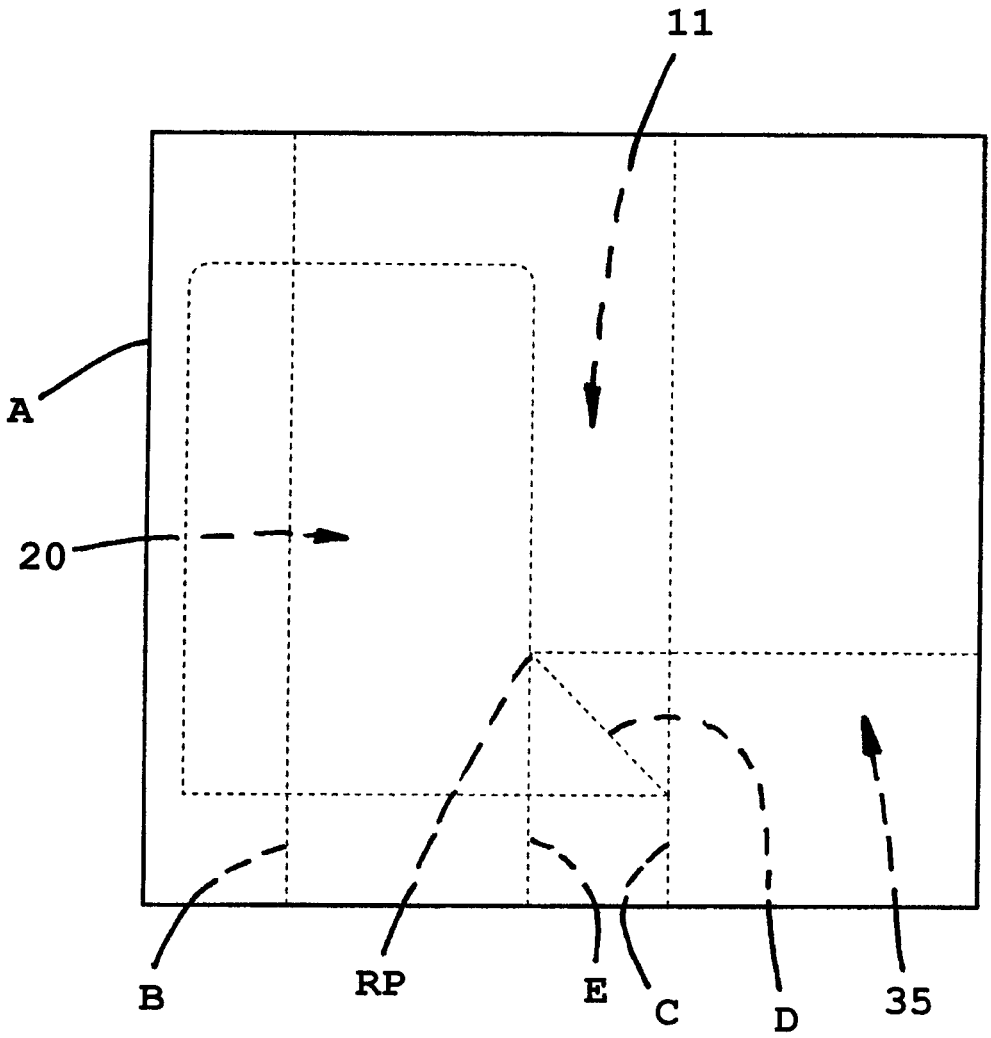
FIG. 5 is a plan view of the popup-structure according to the present invention in which its closure is complete, with the covers in a common plane.

FIGS. 2-5 depict the popup-structure according to the present invention in different states, FIG. 2 depicting a fully open structure and FIG. 5 a fully closed structure. For greater clarity, the gift card is omitted in FIGS. 2-5.

In FIG. 2 the popup-structure is fully open and the first cover 1 and the second cover 3 are in a common plane. A popup-mechanism, which is preferably likewise integral and made of cardboard, is attached to the portion of the covers 1 and 3 which faces towards the observer in FIG. 2. This mechanism is described in detail below.

As illustrated in FIG. 2, the popup-mechanism comprises a first panel element 5 which in the embodiment depicted is rectangular and defined by three edges 7, 9, 10 which coincide with corresponding edges of the first cover 1 which are masked in FIG. 2. The fourth edge of the rectangular first panel element 5 takes the form of a second fold line B represented by a broken line in FIG. 2. The first panel element 5 is connected to the first cover 1, preferably by adhesive bonding.

The popup-mechanism comprises also a second panel element 11 which in the embodiment depicted is rectangular and has an edge constituted by the second fold line B. This rectangular second panel element also has two mutually opposite edges 12 and 13. Its fourth edge is made up of three different sections. A third fold line C constitutes a first section of this fourth edge. The second fold line B and the third fold line C extend in the same direction in the plan view in FIG. 2 but are not necessarily entirely parallel with one another.

A first slit S1 in the popup-mechanism serves as a second section 14 of the fourth edge of the second panel element 11, and a third section 15 of this fourth edge extends from the first slit S1 to the end of one opposite edge 12.

The second panel element 11 is not connected to the covers 1 and 3. The first fold line A depicted in FIG. 2 is masked behind the second panel element 11.

The popup-mechanism comprises also a tongue 20 on which the card of bank card format has to be fastened, e.g. by adhesive bonding. This tongue 20 has a first edge 21 generated by the first slit S1. The tongue 20 is also defined by a second edge 22 which extends transversely to the first edge 21, and by a third edge 23 which extends transversely to the second edge 22. The tongue 20 is also defined by a fourth edge 24 which is constituted by a second slit S2 in the popup-mechanism and which extends transversely to the third edge 23. Finally, the tongue 20 is also defined by a fifth fold line D which extends between the first edge 21 and the fourth edge 24. The fifth fold line D has a generally diagonal extent. An angle between the fifth fold line D and an auxiliary line HL is designated α. The auxiliary line HL extends from the intersection point between the third fold line C and the fifth fold line D and forms a right angle with a fourth fold line E. The tongue 20 is not connected to the second cover 3.

The popup-mechanism comprises also a third panel element 30 which in the embodiment depicted has the shape of a parallel trapezium. This third panel element is defined by the third fold line C, the fifth fold line D, the fourth fold line E and an edge 31 which extends between the third fold line C and the fourth fold line E. In the embodiment depicted, the third fold line C and the fourth fold line E extend in the same direction in the plan view in FIG. 2 but are not necessarily entirely parallel with one another. In FIG. 2 the length of the third fold line is designated L1 and the length of the fourth fold line L2. The lengths L1 and L2 run from the edge 31 which extends between the third fold line C and the fourth fold line E. It will generally be the case that L2>L1. In the embodiment depicted, L2 is at least twice as great as L1. The third panel element 30 is not connected to the second cover 3.

Finally, the popup-mechanism comprises a fourth panel element 35 which in the embodiment depicted is rectangular and defined by the fourth fold line E, a first edge 36, a second edge 37 and a third edge 38. In the embodiment depicted, the second and third edges 37, 38 coincide with edges of the second cover 3. The fourth panel element 35 is connected to the second cover 3, preferably by adhesive bonding.

FIG. 3 is a light perspective view showing how the popup-structure behaves when the first cover 1 is turned away from the common plane in which the covers 1, 3 are in FIG. 2. This turning of the first cover 1 causes its outer edge 9 to move towards the observer. The first cover 1 thus turns relative to the second cover 3 via the first fold line A. At the same time, the rectangular second panel element 11 turns relative to the first cover 1 via the second fold line B. This results in the second panel 11 element assuming a position transverse to the first cover 1 and away from the second cover 3, thereby creating a space between the second panel element 11 and the second cover 3, as illustrated clearly in FIG. 3.

At the same time, the second panel element 11 also turns relative to the third panel element 30 which in the embodiment depicted has the shape of a parallel trapezium. This turning takes place via the third fold line C. This turning of the second panel element 11 relative to the third panel element 30 also results in the third panel element 30 turning relative to the second cover 3 via the fourth fold line E. The third panel element 30 will thus extend transversely to the second cover 3, as illustrated in FIG. 3.

At the same time as the third panel element 30 moves to the position depicted in FIG. 3, it also turns relative to the tongue 20, via the fifth fold line D. At this stage it should be noted that the third panel element 30 extends transversely to the second cover 3 while the tongue 20 assumes a position along the second cover 3. In this context it should be noted that at the same time as the third panel element 30 moves to become oriented transversely to the second cover 3 and the tongue 20 extends along the second cover 3, the tongue 20 also rotates so that its edge 24 forms an acute angle with the edge 36 of the fourth rectangular panel element 35. This rotation of the tongue 20 takes place about a point RP at which the fifth fold line D and the fourth fold line E meet and which is an end-point of the fourth fold line E. As illustrated in FIG. 3, the rotation of the tongue 20 involves part of it moving in behind the second panel element 11.

FIG. 4 illustrates the continued rotation of the tongue 20 during which the turning of the first cover 1 relative to the second cover 3 will have proceeded via the first fold line A. Comparison of FIG. 3 and FIG. 4 shows that a continued turning of the third panel element 30 relative to the fourth fold line E has taken place. In the state depicted in FIG. 3, the third fold line C and the fifth fold line D are to the left of the fourth fold line E, but in FIG. 4 they are to the right of it. This change of position of the third fold line C and the fifth fold line D relative to the fourth fold line E causes a further rotation of the tongue 20 about the point RP. In the state depicted in FIG. 4, the greater part of the tongue 20 has moved into the space between the second cover 3 and the second panel element 11.

FIG. 5 illustrates how the popup-structure according to the present invention closes so that the first and second covers 1 and 3 overlap one another and are in a common plane. Comparison of FIG. 4 and FIG. 5 shows that continued closing of the popup-structure according to the present invention from the state in FIG. 4 to the state in FIG. 5 will cause the third fold line C to move further to the right and come into contact with the rectangular fourth panel element 35.

Comparison of FIG. 2 and FIG. 5 shows that the fifth fold line D has moved from a position in which it extends obliquely left downwards from the rotation point RP as in FIG. 2 to a position in which it extends obliquely right downwards from the rotation point as in FIG. 5. As the fifth fold line D is part of the tongue 20, this change in its position will also cause a change of position of the tongue 20, as may be seen by comparing FIG. 2 and FIG. 5. In FIG. 2 the tongue 20 assumes a "horizontal" position but in FIG. 5 it assumes a "vertical" position in which it is fully inserted in the space between the second panel element 11 and the second cover 3, thus being entirely masked in plan view in FIG. 5, since the second panel element 11 is rectangular in the embodiment depicted. The tongue 20 has thus rotated a quarter-turn (90°) about the rotation point RP, from the position in FIG. 2 to that in FIG. 5. Throughout this rotation the tongue 20 has an extent along the second cover 3.

Figure 6:
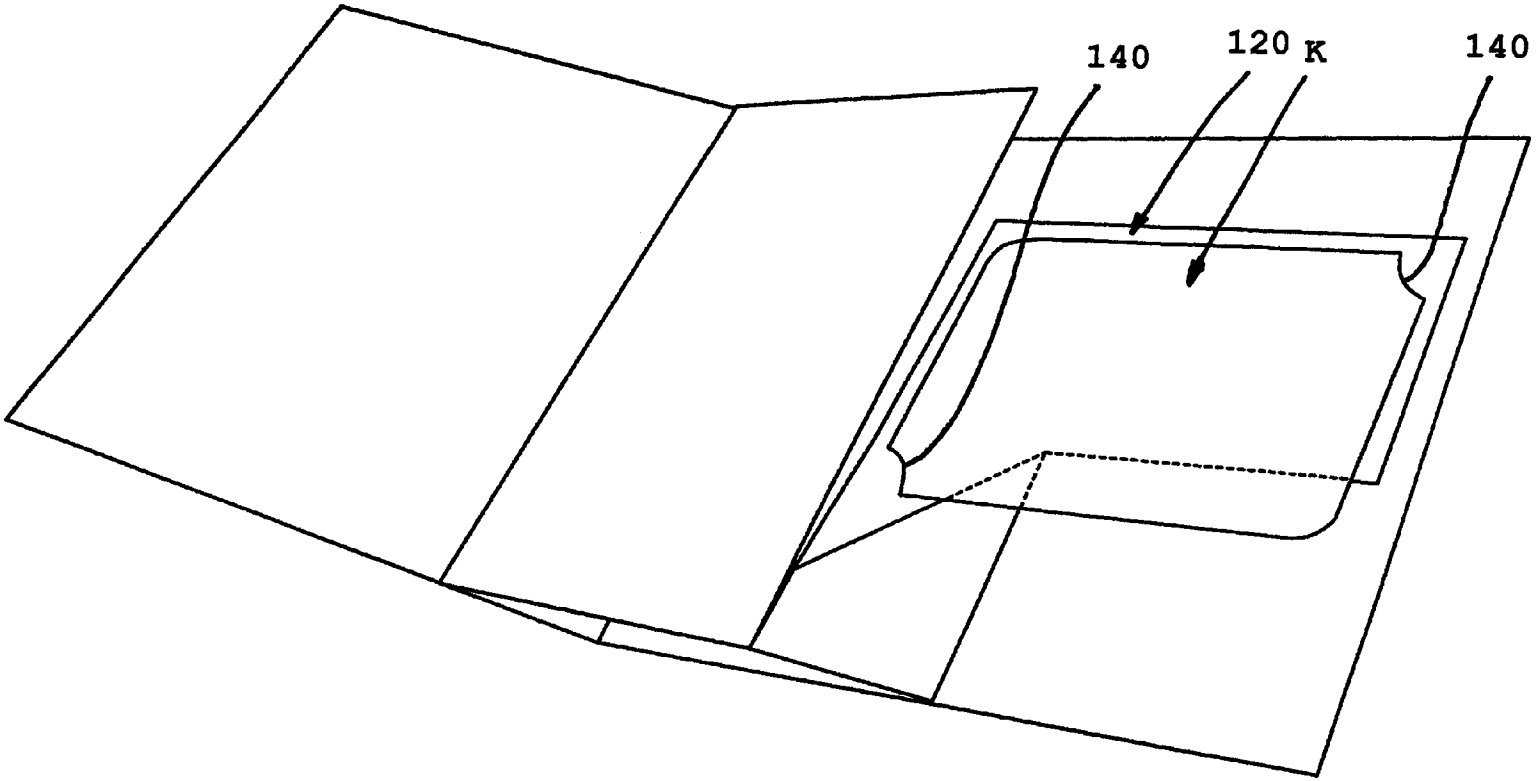
FIG. 6 is a perspective view of an alternative way of supporting a card on a tongue which forms part of the popup-structure.

FIG. 6 depicts an alternative configuration of the fastening of the card K to the tongue 120. Slits 140 are provided in the region of two diagonal corners of the tongue 120 for the insertion of two diagonal corners of the card K. The card K is thus supported by the tongue 120.

Figure 7:
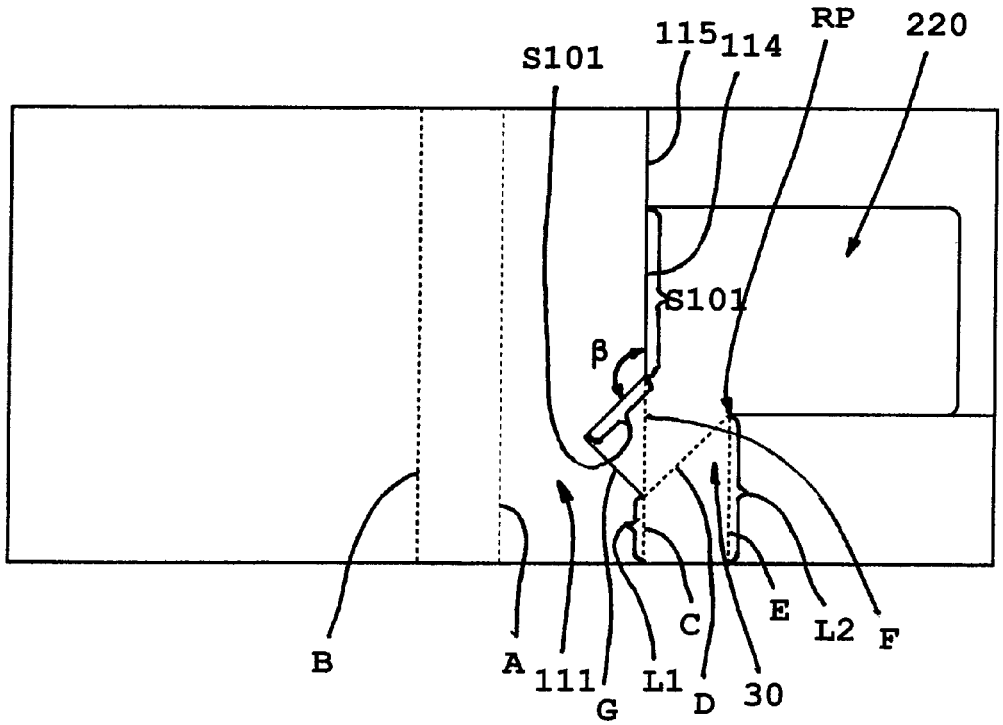
FIG. 7 is a plan view of an alternative embodiment of a popup-structure according to the present invention when the structure is open, i.e. when covers which form part of it are in a common plane.
Figure 8:
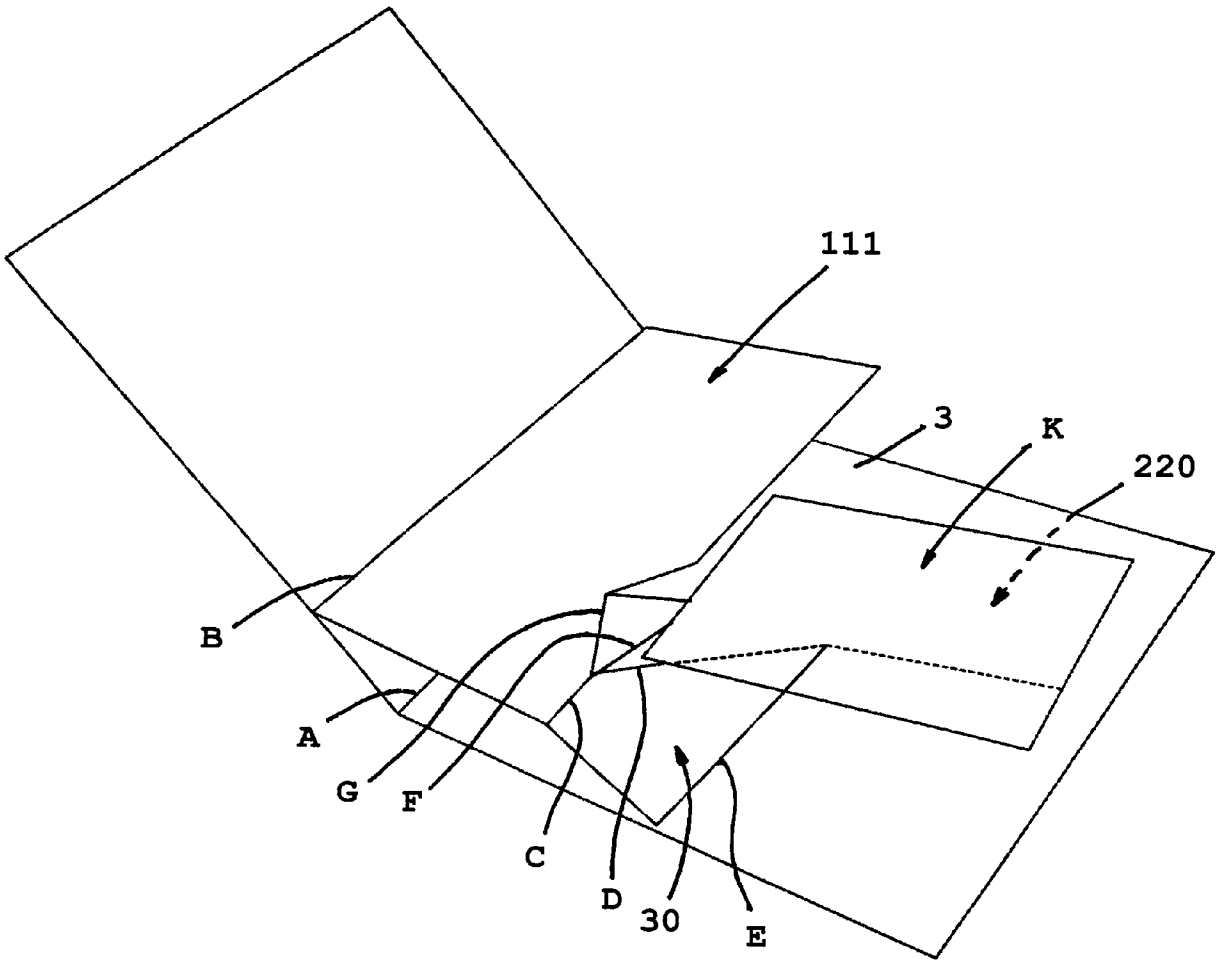
FIG. 8 is a perspective view of the embodiment depicted in FIG. 7 in an intermediate state in which a card is supported by a tongue which forms part of the popup-structure.

The alternative embodiment of a popup-structure according to the present invention depicted in FIGS. 7 and 8 differs from that in FIGS. 1-5 in various respects but the parts/portions which are substantially similar in both embodiments have the same reference notations.

The configuration of the first slit S101 is different from the first slit S1. As illustrated in FIG. 7, the first slit S101 takes the form of two sections at an angle to one another such that one of them extends into the rectangular second panel element 111. The two sections of the first slit S101 thus define between them an obtuse angle β.

In the embodiment depicted, the third fold line C and the fourth fold line E extend in the same direction in the plan view in FIG. 7 but are not necessarily entirely parallel with one another.

A sixth fold line F extends from the intersection point of the two sections of the first slit S101 to the inner end of the third fold line C. A seventh fold line G extends between the inner end of the third fold line C and the end of the first slit S101 which is situated in the rectangular second panel element 111.

FIG. 8 depicts the alternative embodiment of the popup-structure in an intermediate state in which the covers are not in a common plane because a certain closing of the popup-structure has taken place. This means that the card K supporting the tongue 220 will rotate about the rotation point RP. In a fully closed state the fifth fold line D will be in the immediate vicinity of the seventh fold line G. Similarly to the embodiment in FIGS. 1-5, the fifth fold line D will move from extending obliquely left downwards from the rotation point RP as in FIG. 7 to extending obliquely right downwards from the rotation point RP, i.e. a fully closed state of the covers. As the fifth fold line D forms part of the tongue 220, this change of position of the fifth fold line D will also cause a change of position of the tongue. In FIG. 7 the tongue 220 assumes a "horizontal" position but in a fully closed state it assumes a "vertical" position in which it is fully inserted in the space between the second panel element 111 and the second cover 3. The tongue 220 will thus have rotated a quarter-turn (90°) about the rotation point RP, from the position in FIG. 7 to the fully closed state of the popup-structure.

Conceivable Modifications of the Invention

The fastening of the fold lines B and E to the covers 1 and 3 may be configured in various different ways. In the embodiment described above and depicted in FIGS. 1A-1E and FIGS. 2-5 these fold lines B and E are fastened to the covers by the fact that panel elements 5 and 35 are connected to the covers 1 and 3, preferably by adhesive bonding. In this context it should be noted that the panel elements 5 and 35 need not have the rectangular shape referred to above. What is important is that they achieve full anchoring of the respective fold lines B and E.

Within the scope of the invention it is also possible to conceive of the fold lines B and E being integral with the respective cover 1 or 3.

In the embodiments described above, the covers and the popup-mechanism are preferably made of cardboard, but it is conceivable within the scope of the present invention to use alternative materials, a non-limitative example which may be cited being suitable plastic material.

In the embodiments described above, the tongue 20; 220 supports a card K but it is possible within the scope of the present invention to conceive of the tongue 20 supporting a generally flat object, e.g. a tablet card or a thin box pack. It is also possible within the scope of the present invention to conceive of the tongue 20 not supporting any flat object, in which case it may be provided with preprinted information or be provided subsequently with information, e.g. by a personal greeting being written on it.

The invention claimed is:

1. A popup-structure comprising:

a first cover having a first panel element and a second cover which are joined together by a first fold line, such that a popup-mechanism forming part of the structure comprises a second panel element that extends between a second fold line and a third fold line, the second fold line is connected to the first cover, the third fold line is movable freely relative to the second cover, the second fold line and the third fold line extend in the same direction, a fourth fold line, a third panel element extends between the third fold line and a fifth fold line which is connected to the second cover, the third fold line and the fifth fold line extend in the same direction, the third panel element connects via a fourth fold line to a tongue which forms part of the popup-mechanism, the fourth fold line extends between an inner end of the third fold line and an inner end of the fifth fold line, and the fifth fold line has a length which is greater than the length of the third fold line, wherein the second panel element is rectangular and an outer edge of the second panel element serves as a continuation of the third fold line.

2. The popup-structure according to claim 1, wherein the tongue supports a flat object.

3. The popup-structure according to claim 2, wherein the fourth fold line forms an angle with an auxiliary line which extends from the intersection point between the third fold line and the fourth fold line at right angles to the fifth fold line, and that the angle is within the inclusive range of 30 degrees to 60 degrees.

4. The popup-structure according to claim 2, wherein the flat object is fastened to the tongue by adhesive bonding.

5. The popup-structure according to claim 2, wherein the flat object is a card, and the card is fastened to the tongue by means of slits provided in the tongue.

6. The popup-structure according to claim 2, wherein the flat object is a card, and the card is fastened to the tongue by adhesive bonding.

7. The popup-structure according to claim 1, wherein the tongue is provided with information or is configured to being provided with information.

8. The popup-structure according to claim 7, wherein the fourth fold line forms an angle with an auxiliary line which extends from the intersection point between the third fold line and the fourth fold line at right angles to the fifth fold line, and that the angle is within the inclusive range of 30 degrees to 60 degrees.

9. The popup-structure according to claim 1, wherein the fourth fold line forms an angle with an auxiliary line which extends from the intersection point between the third fold line and the fourth fold line at right angles to the fifth fold line, and that the angle is within the inclusive range of 30 degrees to 60 degrees.

10. The popup-structure according to claim 9, wherein the angle is of the order of 45 degrees.

11. The popup-structure according to claim 10, wherein the tongue supports a card and the card is fastened to the tongue by adhesive bonding.

12. The popup-structure according to claim 10, wherein the tongue supports a card and the card is fastened to the tongue by means of slits provided in the tongue.

13. The popup-structure according to claim 9, wherein the tongue supports a card and the card is fastened to the tongue by adhesive bonding.

14. The popup-structure according to claim 9, wherein the tongue supports a card and the card is fastened to the tongue by means of slits provided in the tongue.

* * * * *